US007878919B2

(12) United States Patent
Perry et al.

(10) Patent No.: US 7,878,919 B2
(45) Date of Patent: Feb. 1, 2011

(54) GOLF CLUB HEAD AND GOLF CLUB ASSEMBLY WITH FASTENER

(75) Inventors: Mark J. Perry, Hilliard, OH (US); Megan Sesslar Moore, Hilliard, OH (US); Matthew S. Young, Columbus, OH (US); David M. Walters, Circleville, OH (US)

(73) Assignee: NIKE, Inc., Beaverton, OR (US)

( * ) Notice: Subject to any disclaimer, the term of this patent is extended or adjusted under 35 U.S.C. 154(b) by 106 days.

(21) Appl. No.: 12/205,264

(22) Filed: Sep. 5, 2008

(65) Prior Publication Data

US 2010/0062872 A1 Mar. 11, 2010

(51) Int. Cl.
*A63B 53/06* (2006.01)

(52) U.S. Cl. ..... 473/288; 473/342; 473/335; 473/345

(58) Field of Classification Search ..... 473/288, 473/342, 334–335, 345–346
See application file for complete search history.

(56) References Cited

U.S. PATENT DOCUMENTS

| | | | | |
|---|---|---|---|---|
| 1,349,805 | A | 8/1920 | Booth | |
| 2,385,180 | A * | 9/1945 | Allen | 411/551 |
| 2,620,539 | A * | 12/1952 | Poupitch | 411/349 |
| 4,884,808 | A | 12/1989 | Retzer | |
| 5,582,553 | A * | 12/1996 | Ashcraft et al. | 473/345 |
| 5,695,296 | A * | 12/1997 | Miura | 403/2 |
| 5,863,261 | A * | 1/1999 | Eggiman | 473/329 |
| 5,911,638 | A * | 6/1999 | Parente et al. | 473/338 |
| 6,217,461 | B1 | 4/2001 | Galy | |
| 6,238,303 | B1 | 5/2001 | Fite | |
| 6,659,883 | B2 | 12/2003 | Nelson et al. | |
| 6,663,502 | B2 | 12/2003 | Nelson et al. | |
| 6,769,724 | B2 * | 8/2004 | Krispin | 292/153 |
| 6,769,853 | B2 * | 8/2004 | Perrot | 411/553 |
| 7,326,121 | B2 | 2/2008 | Roake | |
| 2002/0022532 | A1 | 2/2002 | Tucker, Sr. | |
| 2002/0098908 | A1 | 7/2002 | James et al. | |
| 2005/0130757 | A1 | 6/2005 | Tucker, Sr. | |
| 2005/0227780 | A1 | 10/2005 | Cover et al. | |
| 2007/0111813 | A1 | 5/2007 | Edel | |
| 2007/0167253 | A1 | 7/2007 | Sizemore, Jr. | |
| 2007/0184915 | A1 | 8/2007 | Mansfield | |

(Continued)

FOREIGN PATENT DOCUMENTS

WO 9735645 A1 10/1997

(Continued)

OTHER PUBLICATIONS

International Search Report and Written Opinion issued Apr. 7, 2010 in corresponding PCT Application No. PCT/US2009/055839.

*Primary Examiner*—Stephen L. Blau
(74) *Attorney, Agent, or Firm*—Banner & Witcoff, Ltd.

(57) ABSTRACT

A golf club head includes a face plate and a body member positioned rearwardly of the face plate and having at least two body components. Each of a plurality of apertures is formed in one of the face plate and the body components. At least one fastener extends through at least two of the apertures, the fasteners being configured to removably secure the face plate and the body components together upon being turned a portion of a revolution.

22 Claims, 4 Drawing Sheets

U.S. PATENT DOCUMENTS

| | | | | |
|---|---|---|---|---|
| 2007/0191138 | A1 | 8/2007 | Cameron | |
| 2007/0207875 | A1 | 9/2007 | Kuan et al. | |
| 2008/0153619 | A1 | 6/2008 | Tucker et al. | |
| 2009/0203465 | A1 * | 8/2009 | Stites et al. | 473/343 |

FOREIGN PATENT DOCUMENTS

| | | | |
|---|---|---|---|
| WO | 2007076304 | A2 | 7/2007 |

* cited by examiner

GOLF CLUB HEAD AND GOLF CLUB ASSEMBLY WITH FASTENER

FIELD OF THE INVENTION

Aspects of this invention relate generally to golf clubs and golf club heads, and, in particular, to golf clubs and golf club heads having a fastener for securing body components together.

BACKGROUND

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

Each user has a particular swing that includes many factors that impact the path of the ball after impact. For example, club head speed, point of impact on the club face, and launch angle are all variables that help determine the path of the ball. A golf club can be customized for a particular user's swing by selecting the club head components that most closely match the type of swing the user has.

The performance of a golf club can vary based on several factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively. Similarly, other factors such as point of impact and launch angle can also affect how the ball travels once it has been struck.

Accordingly, club heads may be formed with various configurations to provide different performance characteristics and "feels." For example, club heads can be configured to have different weights secured thereto to alter the performance characteristics and "feel" of the club. In other club heads, a component having a characteristic with a particular value, e.g., size or weight, can be replaced with another component having a different value for that characteristic. By varying the body components of a club head, its performance and "feel" can be altered.

It would be desirable to provide a golf club and golf club head with a fastener for securing body components together that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide a golf club and golf club head with a fastener for securing body components together. In accordance with a first aspect, a golf club head includes a face plate and a body member positioned rearwardly of the face plate and having at least two body components. Each of a plurality of apertures is formed in one of the face plate and the body components. Included is at least one fastener, with each fastener extending through at least two of the apertures, and being configured to removably secure the face plate and the body components together upon being turned a portion of a revolution.

In accordance with another aspect, a golf club head includes a crown portion having at least one first aperture and a first recess formed therein. A sole portion is positioned beneath the crown and has at least one second aperture and a second recess formed therein. A face plate is received in the first and second recesses. Included is at least one fastener, with each fastener extending through a first aperture and a second aperture, and being configured to secure the face plate, the crown portion, and the sole portion together upon being turned a portion of a revolution.

In accordance with a further aspect, a golf club assembly includes a shaft and a club head secured to the first end of the shaft. The club head includes a face plate; a body member positioned rearwardly of the face plate and having at least two body components; and a plurality of apertures, with each aperture being formed in one of the face plate and the body components. Included is at least one fastener, with each fastener extending through at least two of the apertures and configured to removably secure the face plate and the body components together upon being turned a portion of a revolution.

Substantial advantage is achieved by providing a golf club and golf club head with a fastener for securing body components together. In particular, certain embodiments allow a user or other individual to quickly and reliably secure the components of a club head together, along with providing the ability to disassemble the club head at a later time to replace or change one or more components of the club head.

These and additional features and advantages disclosed here will be further understood from the following detailed disclosure of certain embodiments.

Figure 1:
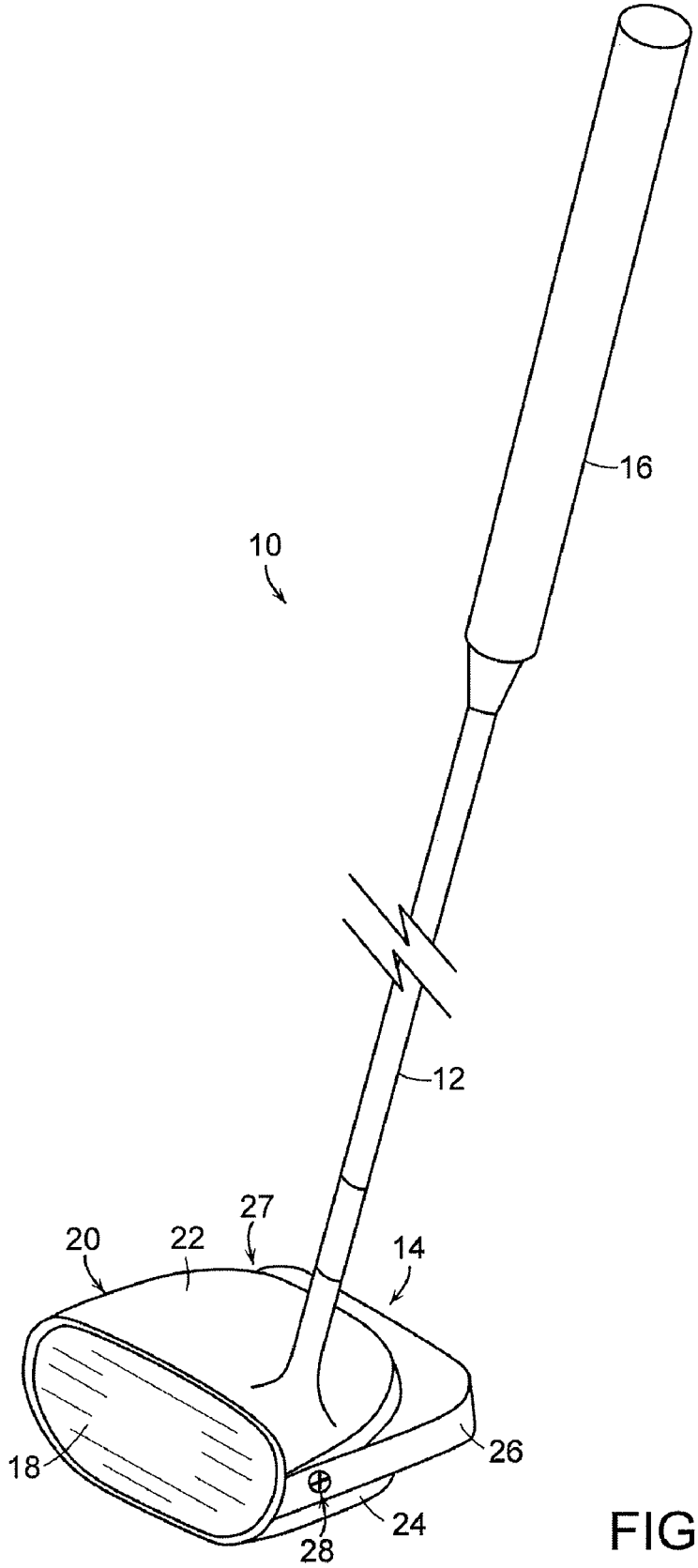
FIG. 1 is a perspective view of a golf club with fasteners according to an illustrative aspect.

The figures referred to above are not drawn necessarily to scale, should be understood to provide a representation of particular embodiments of the invention, and are merely conceptual in nature and illustrative of the principles involved. Some features of the golf club and golf club head with a fastener for securing body components together depicted in the drawings have been enlarged or distorted relative to others to facilitate explanation and understanding. The same reference numbers are used in the drawings for similar or identical components and features shown in various alternative embodiments. Golf clubs and golf club heads with a fastener for securing body components together as disclosed herein would have configurations and components determined, in part, by the intended application and environment in which they are used.

DETAILED DESCRIPTION OF CERTAIN EMBODIMENTS

An illustrative embodiment of a golf club 10 is shown in FIG. 1 and includes a shaft 12 and a golf club head 14 attached to shaft 12. Golf club head 14 may be any driver, wood, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 16 is positioned on shaft 12 to provide a golfer with a slip resistant surface with which to grasp golf club shaft 12. Grip element 16 may be attached to shaft 12 in any desired manner, including in conventional manners known and used in the art (e.g., via adhesives or cements, via threads or other mechanical connectors, via fusing techniques, via friction fits, via retaining element structures, etc.).

Figure 2:
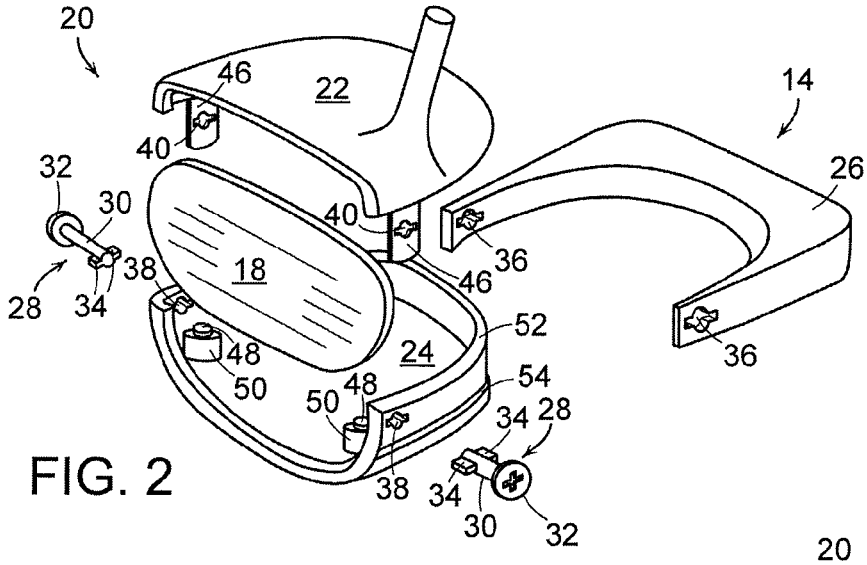
FIG. 2 is an exploded view of the club head of the golf club of FIG. 1.

FIG. 2 illustrates an embodiment of golf club head 14 in more detail. Club head 14 includes a plurality of components. As illustrated, this example golf club head 14 includes a face plate 18 and a body member 20 positioned behind face plate 18. Body member 20 includes at least two body components. In the illustrated embodiment, body member 20 includes a crown portion 22, a sole portion 24 and a skirt 26 extending rearwardly from crown portion 22 and sole portion 24. It is to be appreciated that body member 20 may include any number of components.

Body member 20 of golf club head 14 may be constructed from a wide variety of different materials, including materials conventionally known and used in the art, such as steel, titanium, aluminum, magnesium, nickel, tungsten, alloys of these metals, graphite, polymers, fiber-reinforced materials, or composites, or combinations thereof. Other suitable materials will become readily apparent to those skilled in the art, given the benefit of this disclosure. It is to be appreciated that crown portion 22 and sole portion 24 may be formed of the same or different material.

The component elements of club head 14 are removably secured to one another with at least one fastener 28. In the illustrated embodiment, two fasteners 28 are shown securing the components of club head 14 to one another. It is to be appreciated that one or more than two fasteners 28 can be used to removably secure the components of club head 14 to one another.

Fasteners 28, or partial revolution fasteners 28, serve to removably secure face plate 18 to body member 20 upon being turned a portion of a revolution, as described in greater detail below. The use of partial revolution fasteners 28 allows a user or other individual to quickly and easily assemble a golf club head 14 formed of multiple components. Thus, for example, a user could be fitted in a shop for a golf club head that is optimized for their swing, and have that club assembled while in the shop. Once the user's swing has been evaluated and the desired components of the club head have been selected, the use of partial revolution fasteners allows the components of the club head to be quickly assembled and removably secured together. Additionally, the use of partial revolution fasteners allows the club head to be disassembled at some future time, which allows for additional components to be added, such as weights, for example, or for select components to be replaced with other components. Thus, it is possible to perform routine maintenance on a club head 14; as components of club head 14 experience fatigue or other performance degradation they can be quickly and easily replaced with other components.

Fasteners 28 are inserted through through-holes, or apertures formed in the components of club head 14, and then turned a partial revolution, which securely engages fastener 28 with the components of body member 20.

Figure 3:
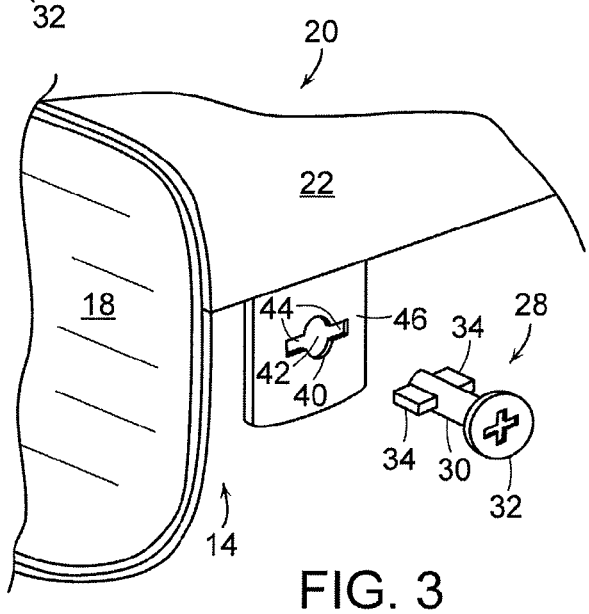
FIG. 3 is an exploded view of a portion of the club head of the golf club of FIG. 1.
Figure 4:
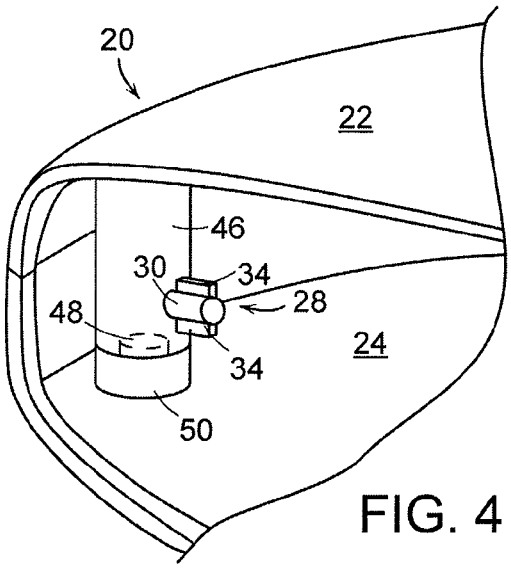
FIG. 4 is a perspective view of a portion of the club head of the golf club of FIG. 1.

As seen in the embodiment illustrated in FIGS. 2-4, fasteners 28 may include a shaft 30, which is shown as being substantially cylindrical in this embodiment. It is to be appreciated that shaft 30 need not be cylindrical, and may, for example, be rectangular in cross-section, or have any other regular or non-regular polygon cross-section.

A head 32 is positioned at a first end of shaft 30, and at least one flange 34 extending outwardly from shaft 30 at its second end. In the illustrated embodiment, a pair of opposed flanges 34 extend outwardly from the second end of shaft 30. It is to be appreciated that shaft 30 may include any number of flanges 34.

After fastener 28 is inserted through an aperture in body member 20 and is turned a portion of a revolution, the innermost surfaces of flanges 34 engage with body member 20, thereby securing the components of club head 14 together. It is to be appreciated that flanges 34 can be of any geometric design, shape, number, or size to create an interference fit when flanges 34 engage body member 20. Further, it is to be appreciated that fastener 28 can be turned any portion of a revolution, for example, a quarter revolution.

In the illustrated embodiment, two fasteners 28 are shown being used to secure the components of club head 14 together. It is to be appreciated that any number of fasteners 28 could be used to secure the components of club head 14 together.

In the illustrated embodiment, head 32 is shown with a Phillips head slot for use with a screwdriver. It is to be appreciated that head 32 could also have a slot head recess for use with a flat screwdriver, a hexagonal socket for use with a hex key, or any other shape suitable for mating with a corresponding tool. Head 32 could also be turned with a wrench in order to tighten fastener 28. Suitable types and shapes of head 32 will become readily apparent to those skilled in the art, given the benefit of this disclosure.

In the embodiment illustrated in FIGS. 1-4, a first pair of apertures 36 is formed in skirt 26, a second pair of apertures 38 is formed in sole portion 24, and a third pair of apertures 40 is formed in crown portion 22. When face plate 18 is engaged with crown portion 22 and sole portion 24 and skirt 26 is positioned about body member 20, first apertures 36, second apertures 38, and third apertures 40 are aligned coaxially with one another. Fasteners 28 are then inserted through the apertures on opposed sides of club head 14 and turned a portion of a revolution. In the illustrated embodiment, with shaft 30 including two flanges 34, fasteners 28 may be turned a quarter revolution. At this point, fasteners 28 are engaged with body member, as most clearly seen in FIG. 4.

In the illustrated embodiment, as seen most clearly in FIG. 3 with respect to a third aperture 40 formed in crown portion 22, each aperture includes a central section 42 and a pair of opposed slots 44 extending outwardly from central section 42. As fastener 28 is inserted through third aperture 40, shaft 30 passes through central section 42 and flanges 34 pass through slots 44. Once fastener 28 is fully inserted into aperture 40, it is turned a portion of a revolution such that flanges 34 are no longer aligned with slots 44 and are abutting a surface of crown portion 22, as seen in FIG. 4. Fasteners 28 now cannot be pulled back through the apertures due to the engagement of flanges 34 with corresponding surfaces of body member 20.

In the illustrated embodiment, slots 44 extend substantially horizontally outward from central section 42 of aperture 40. When fastener 28 is turned a portion of a revolution, for example, a quarter revolution, flanges 34 extend substantially vertically away from shaft 30, as seen in FIG. 4. It is to be appreciated that slots 44 can be of any geometric design, shape, number, or size, and can extend in any direction, and are not limited to the horizontally extending direction shown in this embodiment.

In certain embodiments, crown portion 22 includes a pair of first registration members that engage a pair of second registration members on sole portion 24 so as to facilitate the alignment and registration of crown portion 22 and sole portion 24 with one another. In the illustrated embodiment, the first registration members are first pillars 46, which extend downwardly from a lower surface of crown portion 22. First pillars 46 are cylindrical members that receive a projection 48 formed on the corresponding second registration members, which are seen as second pillars 50 in the illustrated embodiment. Second pillars 50 extend upwardly from an upper surface of sole portion 24. The engagement of projections 48 of second pillars 50 with first pillars 46 serves to help align and register crown portion 22 and sole portion 24 with respect to one another. Each aperture 40 is formed in one of pillars 46.

In the illustrated embodiment, skirt 26 is seated in a recess 52 formed about the periphery of sole portion 24 and rests upon a shoulder 54 of sole portion 24. It is to be appreciated that in other embodiments, such a recess for receiving skirt 26 could be formed in crown portion 22.

In certain embodiments, face plate 18 and body member 20 engage and are interlocked with one another, that is, elements formed on face plate 18 and body member 20 engage with one another in interlocking fashion such that face plate 18 and body member 20 are restricted from moving with respect to one another.

Figure 5:
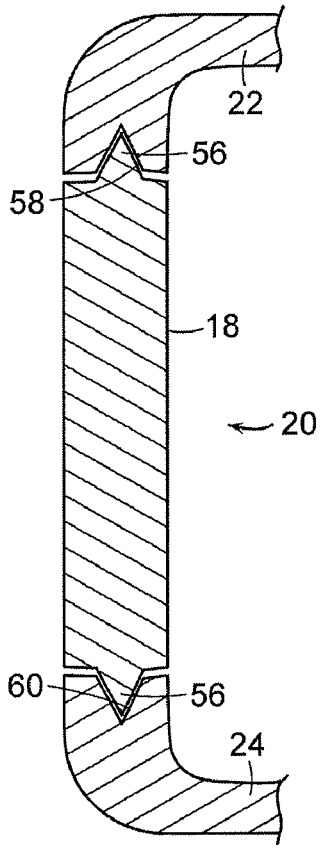
FIG. 5 is a section view of a portion of the club head of the golf club of FIG. 1.

In certain embodiments, as shown in FIG. 5, a projection 56 is formed about the periphery of face plate 18. A corresponding or mating first groove or first recess 58 is formed in a lower surface of the front edge of crown portion 22 and receives a portion of projection 56. Similarly, a second groove or second recess 60 is formed in an upper surface of a front edge of sole portion 24 and receives a portion of projection 56. Thus, when crown portion 22 and sole portion 24 are secured to one another with fasteners 28, the engagement of projection 56 with first and second recesses 58, 60 of crown portion 22 and sole portion 24, respectively, keeps face plate 18 engaged with body member 20.

Figure 6:
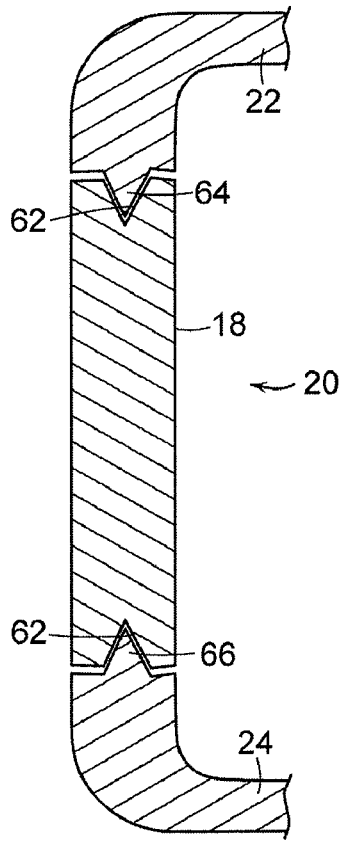
FIG. 6 is a section view of an alternative embodiment of a portion of the club head of the golf club of FIG. 1.

In other embodiments, as seen in FIG. 6, it is to be appreciated that face plate 18 may have a groove or recess 62 formed about its periphery that engages with a mating and corresponding first projection 64 formed in a lower surface of the front edge of crown portion 22 and a mating and corresponding second projection 66 formed in an upper surface of the front edge of sole portion 24.

Figure 7:
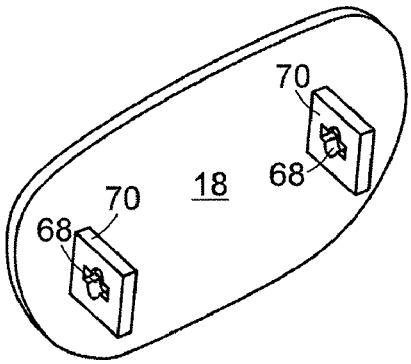
FIG. 7 is a perspective rear view of an alternative embodiment of the face plate of the club head of the golf club of FIG. 1.

In other embodiments, as illustrated in FIG. 7, face plate 18 may include a pair of apertures 68 through which fasteners 28 extend, thereby directly securing face plate 18 to body member 20 by way of fasteners 28. In the illustrated embodiment, a pair of flanges 70 extends rearwardly from face plate 18, with apertures 68 being formed in flanges 70.

Figure 8:
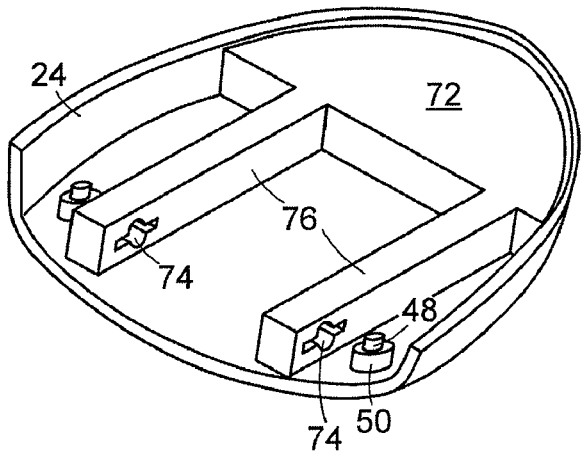
FIG. 8 is a perspective view of another aspect of a sole portion of a golf club head shown with a weight attached thereto.

In certain embodiments, additional components can be added to club head 14. For example, as illustrated in FIG. 8, an additional weight 72 can be removably secured to the other components of club head 14 by way of fasteners 28. In the illustrated embodiment, club head 14 is shown with weight 72 positioned within sole portion 24 of body member 20. A pair of apertures 74 is provided in weight 72, with fasteners 28 extending through apertures 74. As seen here, weight 72 includes a pair of forwardly extending arms 76, with an aperture 74 being formed in each arm 76.

It is to be appreciated that weight 72 can have any desired shape and that weight 72 can be positioned at any location on club head 14, including being positioned in or on skirt 26, or at any other location on the exterior of body member 20. It is also to be appreciated that more than one weight 72 can be secured to club head 14, and that each weight 72 can be positioned at any desired location within or on club head 14.

Since club head 14 can be quickly and easily assembled and disassembled through the use of fasteners 28, the component parts of club head 14 can be quickly and easily interchanged or replaced with other components. Accordingly, a user can have a variety of different club head components that can be substituted for one another for a variety of reasons. For example, a club component can be selected based on playing conditions expected to be encountered (e.g., different course conditions, different weather conditions, different wind conditions, etc.), the type of golf ball being used, and the skill or ability of the golfer. As a user improves, they may adapt a different playing style, and being able to replace the club head component allows them to modify their club without purchasing an entirely new club. It is to be appreciated that all aspects of the geometry or mass properties of club head 14 can be modified through the use of the interchangeable club head components including, but not limited to, the club head's shape, weight, weight distribution, bounce angle, center of gravity, moment of inertia, material of which it is formed, and appearance, which can alter the center of gravity, moment of inertia, and/or other "feel" characteristics of club head 14.

Figure 9:
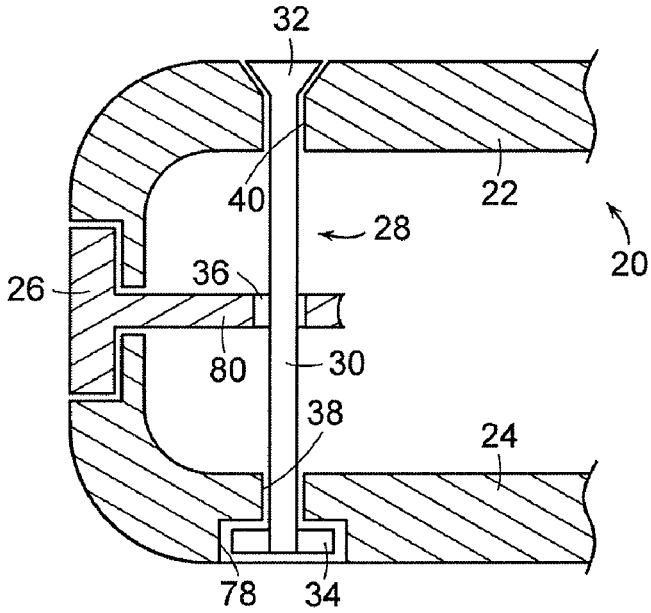
FIG. 9 is a section view of an alternative embodiment of components of a club head of a golf club secured to one another with a fastener.

As noted above, fasteners 28 can be positioned at any location on club head 14. In certain embodiments, as illustrated in FIG. 9, fasteners 28 extend vertically through body member 20 of club head 14. In this embodiment, apertures 40 extend vertically through crown portion 22 and apertures 38 extend vertically through sole portion 24. Recesses 78 formed in the lower surface of sole portion 24 receive flanges 34 at the second end of fastener 28. A pair of flanges 80 extends inwardly from skirt 26, with apertures 36 extending downwardly through flanges 80. Shaft 30 of fasteners 28 extend through apertures 40 of crown portion 24, apertures 36 of skirt 26, and apertures 38 of sole portion 24. Thus, it is to be appreciated that fasteners 28 can be positioned at any location with club head 14.

Figure 10:
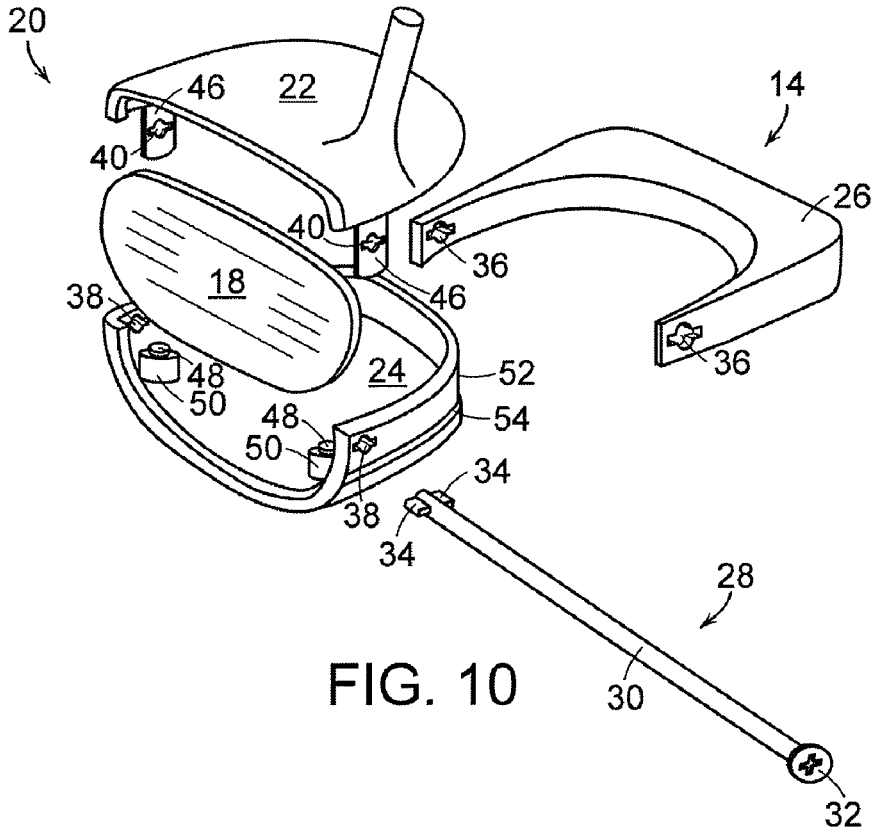
FIG. 10 is a perspective view of an alternative embodiment of a golf club with a fastener according to an illustrative aspect.

In certain embodiments, as illustrated in FIG. 10, the components of club head 14 can be removably secured to one another with a single fastener 28. Thus, in the illustrated embodiment, the single fastener 28 would extend through both apertures 36 in skirt 26, through both apertures 38 in sole portion 24, and through both apertures 40 in crown portion 22. Thus, it can be seen that with at least one fastener 28, the plurality of components that make up club head 14 can reliably be secured to one another quickly and easily.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a face plate;

a body member positioned rearwardly of the face plate and having at least two body components;

a plurality of apertures, each aperture being formed in one of the face plate and the body components, at least one aperture including a central section and a pair of opposed slots formed on a periphery of the central section;

at least one fastener, each fastener extending completely through at least two of the apertures and configured to removably secure the face plate and the body components together upon being turned a portion of a revolution.

2. The golf club head of claim 1, wherein the body member includes a crown portion and a sole portion.

3. The golf club head of claim 2, wherein each of the crown portion and the sole portion includes a pair of apertures extending therethrough, with one fastener extending through one of the apertures in the crown portion and through one of the apertures in the sole portion, and another fastener extending through the other of the apertures in the crown portion and through the other of the apertures in the sole portion.

4. The golf club head of claim 2, wherein the body member includes a skirt positioned rearwardly of the crown portion and the sole portion and having a pair of apertures extending therethrough, with one fastener extending through one of the apertures in the skirt, and another fastener extending through the other of the apertures in the skirt.

5. The golf club head of claim 2, wherein the face plate includes a projection extending outwardly about its peripheral edge, the crown portion includes a first recess formed therein, and the sole portion includes a second recess formed therein, the projection being received in the first and second recesses.

6. The golf club head of claim 2, wherein the face plate includes a recess extending about its peripheral edge, the crown portion includes a first projection, and the sole portion includes a second projection, the first and second projections being received in the recess.

7. The golf club head of claim 1, wherein at least one fastener includes a shaft, a head at a first end of the shaft, and at least one flange extending outwardly from a second end of the shaft.

8. The golf club head of claim 7, wherein the fastener includes a pair of opposed flanges extending outwardly from the second end of the shaft.

9. The golf club head of claim 1, further comprising a weight secured to the body member with the fasteners.

10. The golf club head of claim 1, wherein the fastener is configured to removably secure the face plate and the body components together upon being turned a quarter revolution.

11. A golf club head comprising:

a crown portion having at least one first aperture and a first recess formed therein;

a sole portion positioned beneath the crown portion and having at least one second aperture and a second recess formed therein;

a face plate received in the first and second recesses;

a skirt positioned rearwardly of the crown portion and the sole body and having at least one third aperture formed therein; and at least one fastener, each fastener extending through the at least one first aperture, the at least one second aperture, and the at least one third aperture and configured to secure the face plate, the crown portion, the skirt, and the sole portion together upon turning each fastener a portion of a revolution.

12. The golf club head of claim 11, wherein at least one aperture includes a central section and a pair of opposed slots formed on a periphery of the central section.

13. The golf club head of claim 11, wherein at least one fastener includes a shaft, a head at a first end of the shaft, and at least one flange extending outwardly from a second end of the shaft.

14. The golf club head of claim 13, wherein the at least one fastener includes a pair of opposed flanges extending outwardly from the second end of the shaft.

15. The golf club head of claim 11, further comprising a weight secured to the body member with the fasteners.

16. The golf club head of claim 11, wherein the fastener is configured to secure the face plate, the crown portion, and the sole portion together upon turning each fastener a quarter revolution.

17. A golf club assembly comprising:

a shaft; and a club head secured to the first end of the shaft and comprising:

a face plate;

a body member positioned rearwardly of the face plate and having at least two body components;

a plurality of apertures, each aperture being formed in one of the face plate and the body components, at least one aperture including a central section and a pair of opposed slots formed on a periphery of the central section;

at least one fastener, each fastener extending completely through at least two of the apertures and configured to removably secure the face plate and the body components together upon being turned a portion of a revolution.

18. The golf club head of claim 17, wherein the body member includes a crown portion and a sole portion.

19. The golf club head of claim 18, wherein each of the crown portion and the sole portion includes a pair of apertures extending therethrough, with one fastener extending through one of the apertures in the crown portion and through one of the apertures in the sole portion, and another fastener extending through the other of the apertures in the crown portion and through the other of the apertures in the sole portion.

20. The golf club head of claim 18, wherein the body member includes a skirt positioned rearwardly of the crown portion and the sole body and having a pair of apertures extending therethrough, with one fastener extending through one of the apertures in the skirt, and another fastener extending through the other of the apertures in the skirt.

21. The golf club head of claim 17, wherein the face plate includes a projection extending outwardly about its peripheral edge, the crown portion includes a first recess formed therein, and the sole portion includes a second recess formed therein, the projection being received in the first and second recesses.

22. The golf club head of claim 17, wherein the face plate includes a recess extending about its peripheral edge, the crown portion includes a first projection, and the sole portion includes a second projection, the first and second projections being received in the recess.

* * * * *